US007815429B1

(12) United States Patent
Clark, Jr.

(10) Patent No.: US 7,815,429 B1
(45) Date of Patent: Oct. 19, 2010

(54) SNOWBALL SLINGER

(75) Inventor: Franklin T. Clark, Jr., St. Augustine, FL (US)

(73) Assignee: EMSCOInc., Girard, PA (US)

( * ) Notice: Subject to any disclaimer, the term of this patent is extended or adjusted under 35 U.S.C. 154(b) by 178 days.

(21) Appl. No.: 12/221,071

(22) Filed: Jul. 30, 2008

(51) Int. Cl.
*B28B 1/00* (2006.01)
*B29C 33/26* (2006.01)
*F41B 3/04* (2006.01)

(52) U.S. Cl. ..... 425/276; 124/5; 273/129 K; 425/278; 425/280; 425/282; 425/318

(58) Field of Classification Search ..... 425/218, 425/221, 276, 278, 279, 280, 281, 282, 283, 425/318, 408, 441, 442, 436 RM; D8/51, D8/52, 54, 55; 81/421, 422, 423, 424, 424.5, 81/426, 426.5; 124/5; 273/129 K
See application file for complete search history.

(56) References Cited

U.S. PATENT DOCUMENTS

| | | | | | |
|---|---|---|---|---|---|
| 436,818 | A | * | 9/1890 | Pickering et al. | 425/318 |
| 1,075,041 | A | * | 10/1913 | Kirkness | 124/5 |
| 1,168,405 | A | * | 1/1916 | McDonald | 294/50.8 |
| 1,222,711 | A | * | 4/1917 | Armstrong | 294/50.8 |
| 1,826,651 | A | * | 10/1931 | Chisholm | 425/221 |
| 1,888,739 | A | * | 11/1932 | Sanders | 425/278 |
| 2,232,393 | A | * | 2/1941 | Knaust | 425/278 |
| D148,951 | S | * | 3/1948 | Pfifferling | D8/54 |
| 2,957,199 | A | * | 10/1960 | Bentley | 425/278 |
| 3,472,217 | A | * | 10/1969 | Erickson | 124/5 |
| 3,995,826 | A | * | 12/1976 | Saunders | 249/161 |
| 4,674,974 | A | * | 6/1987 | Godijn | 431/337 |
| 4,859,167 | A | * | 8/1989 | Maerz et al. | 425/276 |
| 5,080,572 | A | * | 1/1992 | Sage | 425/276 |
| D342,002 | S | * | 12/1993 | Sage | D8/52 |
| D371,287 | S | * | 7/1996 | Gilbert, Jr. | D8/52 |
| 5,793,018 | A | * | 8/1998 | Jett | 219/225 |
| 6,076,829 | A | * | 6/2000 | Oblack | 273/317 |
| D435,069 | S | * | 12/2000 | Berardelli | D21/484 |
| 7,128,556 | B2 | * | 10/2006 | Wessells et al. | 425/276 |
| 7,179,078 | B1 | * | 2/2007 | Bauer | 425/283 |
| D567,602 | S | * | 4/2008 | Choy et al. | D8/14 |
| 7,461,880 | B2 | * | 12/2008 | Norton et al. | 294/50.8 |
| 7,461,881 | B2 | * | 12/2008 | Norton et al. | 294/50.8 |
| 7,640,831 | B1 | * | 1/2010 | Vitale | 81/3.36 |
| 2005/0028800 | A1 | * | 2/2005 | Wessells et al. | 124/5 |
| 2008/0308086 | A1 | * | 12/2008 | Wessells et al. | 124/5 |
| 2009/0252822 | A1 | * | 10/2009 | Palmer | 425/318 |

* cited by examiner

*Primary Examiner*—Yogendra N Gupta
*Assistant Examiner*—Emmanuel S Luk
(74) *Attorney, Agent, or Firm*—Richard K Thomson

(57) ABSTRACT

A device has a first arm with a cup at a first distal end and a handle at a second proximal end with a second similarly configured arm pivoted thereto. The second cup forms an obtuse angle with its arm. Each of the first and second arms has an slight elbow bend so that the hurling cup trails the handles by a slight amount. Drawing the handles apart in a scissor-opening motion compacts the snow into a cohesive snowball that may then be slung.

3 Claims, 2 Drawing Sheets

SNOWBALL SLINGER

BACKGROUND AND SUMMARY OF THE INVENTION

The present invention is directed to the field of toys. More particularly, the present invention is directed to an implement for making and launching a snowball.

A number of prior attempts have been made to manufacture a snowball maker. The first of which Applicant is aware is shown in U.S. Pat. No. 5,080,572 issued to Sage. This device utilizes a pliers-type or sheers-type device to compress snow into snowballs. It is not designed for, nor disclosed as being capable of, tossing the created snow ball. U.S. Pat. No. 7,128,556 issued to Wessells et al. attempts to overcome this shortcoming. The Wessells et al. device is designed to operated by one hand by manually clasping the clamshell device comprised of a semi-spherical former 115 and scoop 110 together to form a snowball. The former pivots back to its original open position, either automatically through a biasing system 120 or, in one embodiment, following actuation by pull ring 510. While, conceptually, single-handed operation sounds appealing, using one hand, particularly without the aid of any mechanical advantage, limits one's ability to impart significant compressive force to the snow to form a cohesive snowball. Besides, there is no particular advantage to single-hand operation, since most people will utilize the same hand to form the snowball as they will to grasp the handle to hurl it.

It is the object of the present invention to provide a practical device capable of forming and throwing a snow ball. The snowball slinger for making and launching a snowball, of the present invention comprises a) a first arm having a first hemispherical snowball-forming cup formed at a first end and a first handle formed at a second end; b) a second arm pivotally attached to the first arm adjacent the first hemispherical cup by a hinge, the second arm having a second hemispherical snowball-forming cup formed at a first end of the second arm and a second handle formed at a second end, the second hemispherical cup forming an acute angle with the second arm, the hinge permitting the second arm to pivot between a first position in which the first and second handles are adjacent each other and the first and second hemispherical cups are spaced apart by a sufficient distance to allow a snowball to emerge therefrom and a second position in which the first and second handles are spaced from one another and the first and second hemispherical cups are touching each other. Preferably, on of the first and second handles has a recess for receiving the other of the first and second handles. Each of the first and second handles have a slight elbow bend in a midportion, the elbow bend of the first handle corresponding in location to the elbow bend of the second handle such that the elbow bends are adjacent each other when the first and second handles are in the first position.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
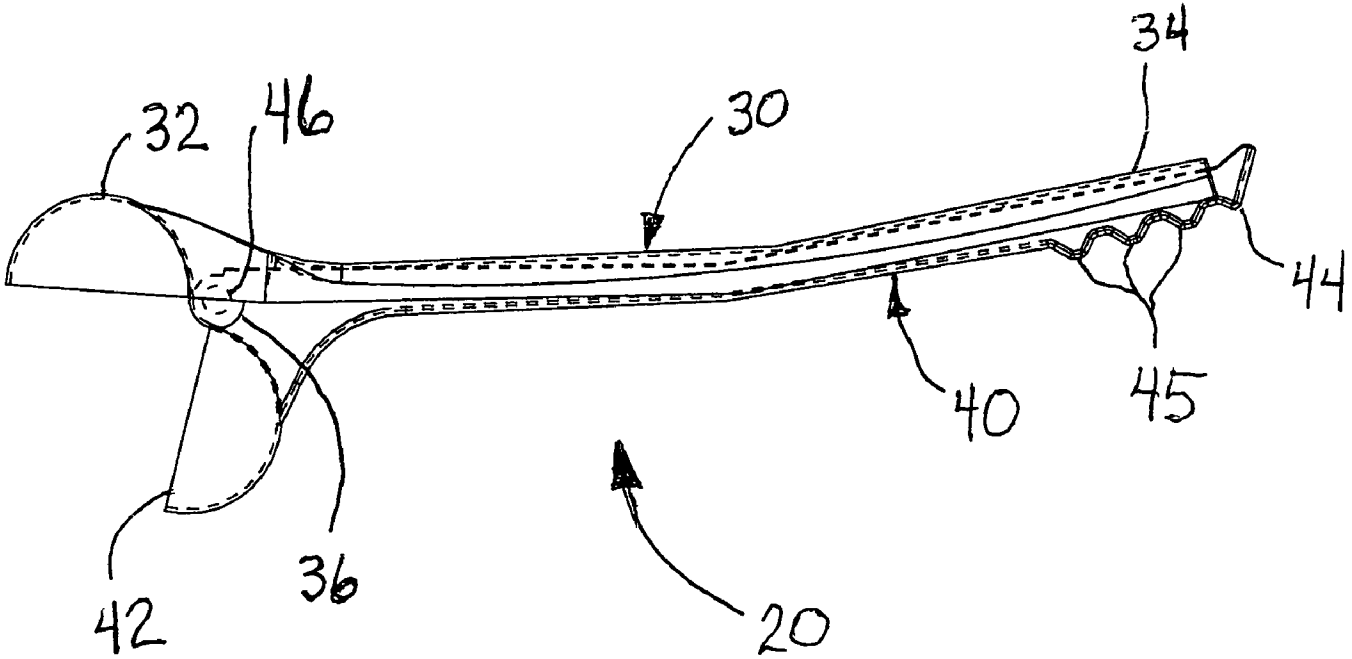
FIG. 1 is a side view of a first embodiment of the snowball thrower of the present invention in a first, slinging position; and, FIG. 2 is a side view of a first embodiment in a second, forming position.
Figure 2:
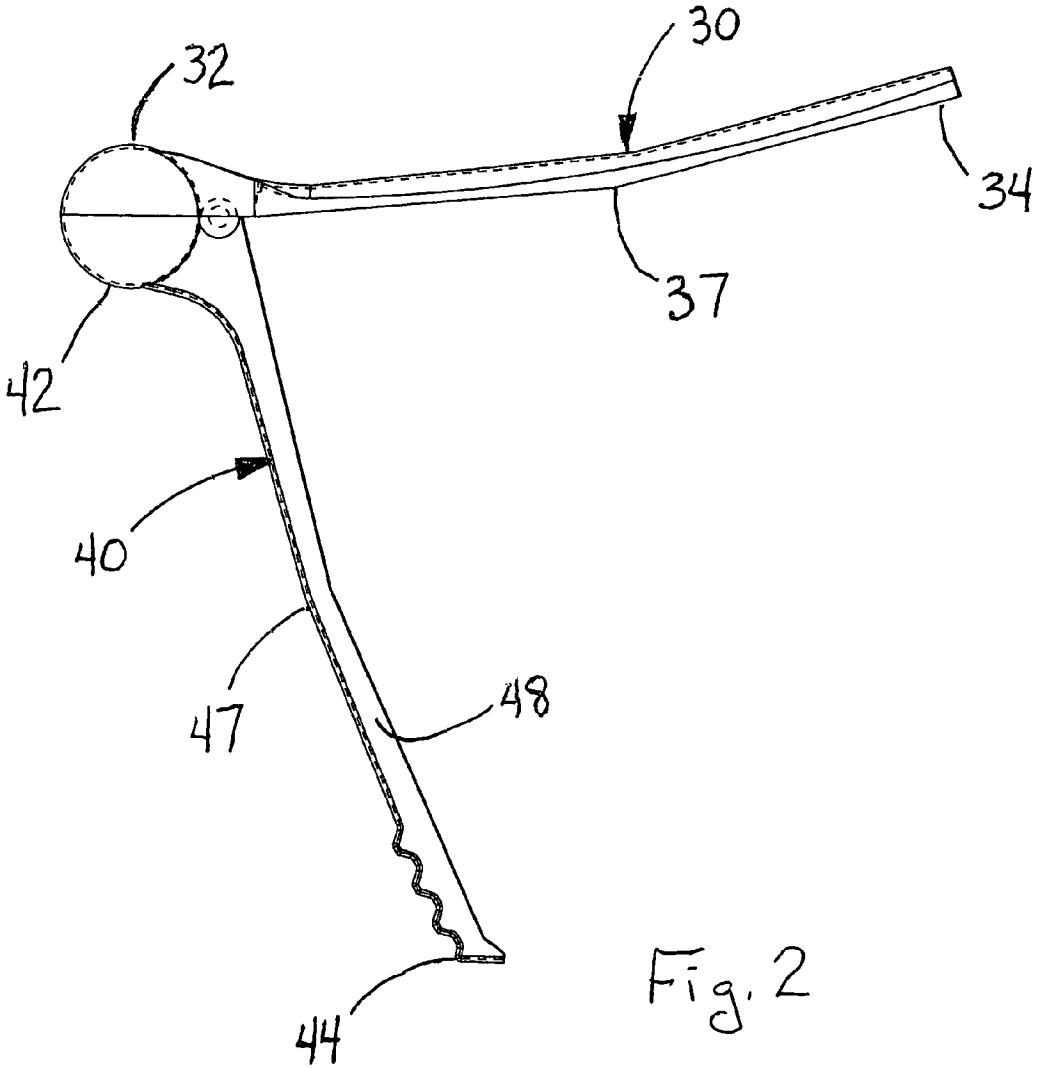

A first embodiment of the snowball slinger of the present invention is depicted generally at 20 in FIGS. 1 and 2. Snowball thrower 20 comprises a first arm 30 having a hemispherical snowball-forming cup 32 formed at a first distal end and a handle 34 formed at a second proximal end. Arm 30 has an elbow 37 midway of its length which positions cup 32 slightly behind handle 34. A pair of ears 36 (one shown) extend in the direction cup 32 faces forming a seat for pintles 46 (one shown) of second arm 40. Pintles 46 form a pivot axis for second arm 40 to pivot about. Second arm 40 has a hemispherical snowball-forming cup 42 formed on a first distal end and a handle 44 formed a a second proximal end, handle 44 having finger grips 45 molded directly into its surface to facilitate retention of the snowball slinger in the user's hand during the throwing motion. Cup 42 forms an obtuse angle with arm 40 allowing a sufficient space between cups 32 and 42 in the first snowball slinging position to permit the snowball to emerge from between the cups. Second arm 40 has an elbow 47 midway along its length that corresponds to the position of elbow 37 of first arm 30 (FIG. 1). The back side 48 of second arm 40 is hollow permitting it to receive first handle 30 when they are in the slinging position depicted in FIG. 1.

To use the snowball slinger 20 of the present invention, snow is loaded into open cups 32, 42 when they are in the position shown in FIG. 1. Alternatively, and preferably, the snowball slinger 20, when in the FIG. 1 position is pushed into a snowbank and the handles 34, 44 drawn apart to take a bite of the snowbank. Pulling handles apart from the first position in which the handles 34, 44 are adjacent each other and the cups 32, 42 are spaced apart, to the second position in which handles 34, 44 are at their maximum spaced distance and cups 32, 42 are touching, compacts the snow captured between cups 32, 42 into a compact snowball. Handles 34, 44 are returned to the first position and grasped in the user's preferred hand (right hand for right-handers, etc.) and, with a throwing motion, the cohesive snowball is slung at the user's selected target. The elbows 37, 47 position hurling cup 32 a slight distance behind handles 34, 44 which enhances the trajectory of the slung snowball.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A snowball slinger for making and launching a snowball, said snowball thrower comprising:

a) a first arm having a first hemispherical snowball-forming cup formed at a first distal end and a first handle formed at a second proximal end; and b) a second arm pivotally attached to said first arm adjacent said first hemispherical cup by a hinge, said second arm having a second hemispherical snowball-forming cup formed at a first end of said second arm and a second handle formed at a second end, said second hemispherical cup forming an obtuse angle with said second arm, said hinge permitting said second arm to pivot between a first position in which said first and second handles are parallel and adjacent each other and said first and second hemispherical cups are spaced apart by a sufficient distance to allow a snowball to emerge therefrom and a second position in which said first and second handles are spaced from one another and said first and second hemispherical cups are touching each other.

2. The snowball slinger of claim 1 wherein one of said first and second handles has a recess for receiving the other of said first and second handles.

3. The snowball slinger of claim 1 wherein said first and second handles each have a slight elbow bend in a mid portion, said elbow bend of said first handle corresponding in location to said elbow bend of said second handle such that said elbow bends are adjacent each other when said first and second handles are in said first position.

* * * * *